US010720013B2

(12) United States Patent
Main, Jr.

(10) Patent No.: US 10,720,013 B2
(45) Date of Patent: Jul. 21, 2020

(54) CASINO CHIP TRAY MONITORING SYSTEM

(71) Applicant: Jerry A. Main, Jr., Fostoria, OH (US)

(72) Inventor: Jerry A. Main, Jr., Fostoria, OH (US)

( * ) Notice: Subject to any disclaimer, the term of this patent is extended or adjusted under 35 U.S.C. 154(b) by 0 days.

(21) Appl. No.: 16/240,082

(22) Filed: Jan. 4, 2019

(65) Prior Publication Data

US 2019/0213830 A1 Jul. 11, 2019

Related U.S. Application Data

(60) Provisional application No. 62/615,055, filed on Jan. 9, 2018.

(51) Int. Cl.

| | |
|---|---|
| ***G07F 17/32*** | (2006.01) |
| ***A63F 11/00*** | (2006.01) |
| *A63F 9/24* | (2006.01) |

(52) U.S. Cl.

CPC ..... *G07F 17/3241* (2013.01); *A63F 11/0002* (2013.01); *G07F 17/322* (2013.01); *G07F 17/3232* (2013.01); *G07F 17/3234* (2013.01); *A63F 2009/2425* (2013.01); *A63F 2011/0006* (2013.01)

(58) Field of Classification Search

CPC ..... G07F 17/3241; G07F 17/3232; G07F 17/322; G07F 17/3234; A63F 2011/0006; A63F 11/0002

See application file for complete search history.

(56) References Cited

U.S. PATENT DOCUMENTS

| | | | | |
|---|---|---|---|---|
| 4,755,941 | A | 7/1988 | Bacchi | |
| 5,757,876 | A | 5/1998 | Dam et al. | |
| 7,316,615 | B2 | 1/2008 | Soltys et al. | |
| 9,779,582 | B1 * | 10/2017 | Ben Hanan | G07F 17/3248 |
| 2002/0042298 | A1 * | 4/2002 | Soltys | G06Q 10/0639 463/29 |
| 2002/0068625 | A1 | 6/2002 | Soltys et al. | |
| 2003/0022614 | A1 | 1/2003 | Momemy | |
| 2003/0064798 | A1 * | 4/2003 | Grauzer | A63F 1/18 463/29 |
| 2003/0176209 | A1 * | 9/2003 | Soltys | A63F 1/18 463/13 |
| 2004/0109525 | A1 | 6/2004 | Chieng | |

(Continued)

OTHER PUBLICATIONS

PCT International Search Report and Written Opinion, Application No. PCT/US19/12275, dated Mar. 27, 2019.

*Primary Examiner* — Jasson H Yoo

(74) *Attorney, Agent, or Firm* — Charles F. Charpie

(57) ABSTRACT

A casino chip tray monitoring system configured for use with a casino game is provided. The casino chip tray includes a casino chip tray having a plurality of chip tubes and one or more displays associated with the casino chip tray. A plurality of gaming chips and/or a plurality of coins are arranged in the plurality of chip tubes. An imaging device is configured to scan the plurality of gaming chips and/or the plurality of coins arranged in the plurality of chip tubes and further configured to discern individual gaming chips from other gaming chips. A total dollar value of the plurality of gaming chips and/or the plurality of coins arranged in the plurality of chip tubes is calculated from an imaging device scan of the plurality of gaming chips and/or the plurality of coins and displayed on the one or more displays.

18 Claims, 6 Drawing Sheets

(56) References Cited

U.S. PATENT DOCUMENTS

| | | | | |
|---|---|---|---|---|
| 2005/0051965 | A1 | 3/2005 | Gururajan | |
| 2006/0019739 | A1 | 1/2006 | Soltys et al. | |
| 2007/0184898 | A1 | 8/2007 | Miller et al. | |
| 2011/0070943 | A1 | 3/2011 | Ratliff | |
| 2012/0238337 | A1 | 9/2012 | French | |
| 2018/0053377 | A1* | 2/2018 | Shigeta | G07F 17/3241 |

* cited by examiner

CASINO CHIP TRAY MONITORING SYSTEM

CROSS-REFERENCE TO RELATED APPLICATIONS

This application claims the benefit of U.S. Provisional Patent Application No. 62/615,055 filed Jan. 9, 2018, the disclosure of which is incorporated herein by reference in its entirety.

BACKGROUND

Casino gaming tables can be manned with dealers having casino chip trays. The casino chip trays can include gaming chips and cash, which can be used for making change for the gaming participants.

In certain instances, the gaming play at the gaming tables can be temporarily suspended as the dealer's inventory the chips and the cash contained in the casino chip trays. The inventory of the chips and the cash can be totaled and the total dollar value can be compared against a desired pre-set dollar total. Unfortunately, the inventory and comparison activity can slow down the gaming action, thereby costing the casino potential revenue from the gaming activity.

It would be advantageous to provide an improved system for inventorying the chips contained in the casino chip trays and the cash taken in at a gaming table.

SUMMARY

It should be appreciated that this Summary is provided to introduce a selection of concepts in a simplified form, the concepts being further described below in the Detailed Description. This Summary is not intended to identify key features or essential features of this disclosure, nor is it intended to limit the scope of the casino chip tray monitoring system.

The above objects as well as other objects not specifically enumerated are achieved by a casino chip tray monitoring system configured for use with a casino game. The casino chip tray includes a casino chip tray having a plurality of chip tubes and one or more displays associated with the casino chip tray. A plurality of gaming chips and/or a plurality of coins are arranged in the plurality of chip tubes. An imaging device is configured to scan the plurality of gaming chips and/or the plurality of coins arranged in the plurality of chip tubes and further configured to discern individual gaming chips from other gaming chips. A total dollar value of the plurality of gaming chips and/or the plurality of coins arranged in the plurality of chip tubes is calculated from an imaging device scan of the plurality of gaming chips and/or the plurality of coins and displayed on the one or more displays.

The above objects as well as other objects not specifically enumerated are also achieved by a method of using a casino chip tray monitoring system configured for use with a casino game. The method includes the steps of equipping a casino chip tray with a plurality of chip tubes and one or more displays, arranging a plurality of gaming chips and/or a plurality of coins in the plurality of chip tubes, scanning the plurality of gaming chips and/or the plurality of coins arranged in the plurality of chop tubes with an imaging device, the imaging device configured to discern individual gaming chips from other gaming chips, calculating a total dollar value of the plurality of gaming chips and/or the plurality of coins arranged in the plurality of chip tubes from an imaging device scan of the plurality of gaming chips and/or plurality of coins and displaying the calculated total dollar value on the one or more displays.

Various objects of the casino chip tray monitoring system will become apparent to those skilled in the art from the following Detailed Description, when read in light of the accompanying drawings.

DETAILED DESCRIPTION

The casino chip tray monitoring system will now be described with occasional reference to the illustrated embodiments. The casino chip tray monitoring system may, however, be embodied in different forms and should not be construed as limited to the embodiments set forth herein. Rather, these embodiments are provided so that this disclosure will be thorough and complete, and will fully convey the scope of the casino chip tray monitoring system to those skilled in the art.

Unless otherwise defined, all technical and scientific terms used herein have the same meaning as commonly understood by one of ordinary skill in the art to which the casino chip tray monitoring system belongs. The terminology used in the description of the casino chip tray monitoring system herein is for describing particular embodiments only and is not intended to be limiting of the casino chip tray monitoring system. As used in the description of the casino chip tray monitoring system and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the casino chip tray monitoring system. Notwithstanding that the numerical ranges and parameters setting forth the broad scope of the casino chip tray monitoring system are approximations, the numerical values set forth in the specific examples are reported as precisely as possible. Any numerical values, however, inherently contain certain errors necessarily resulting from error found in their respective measurements.

Figure 1:
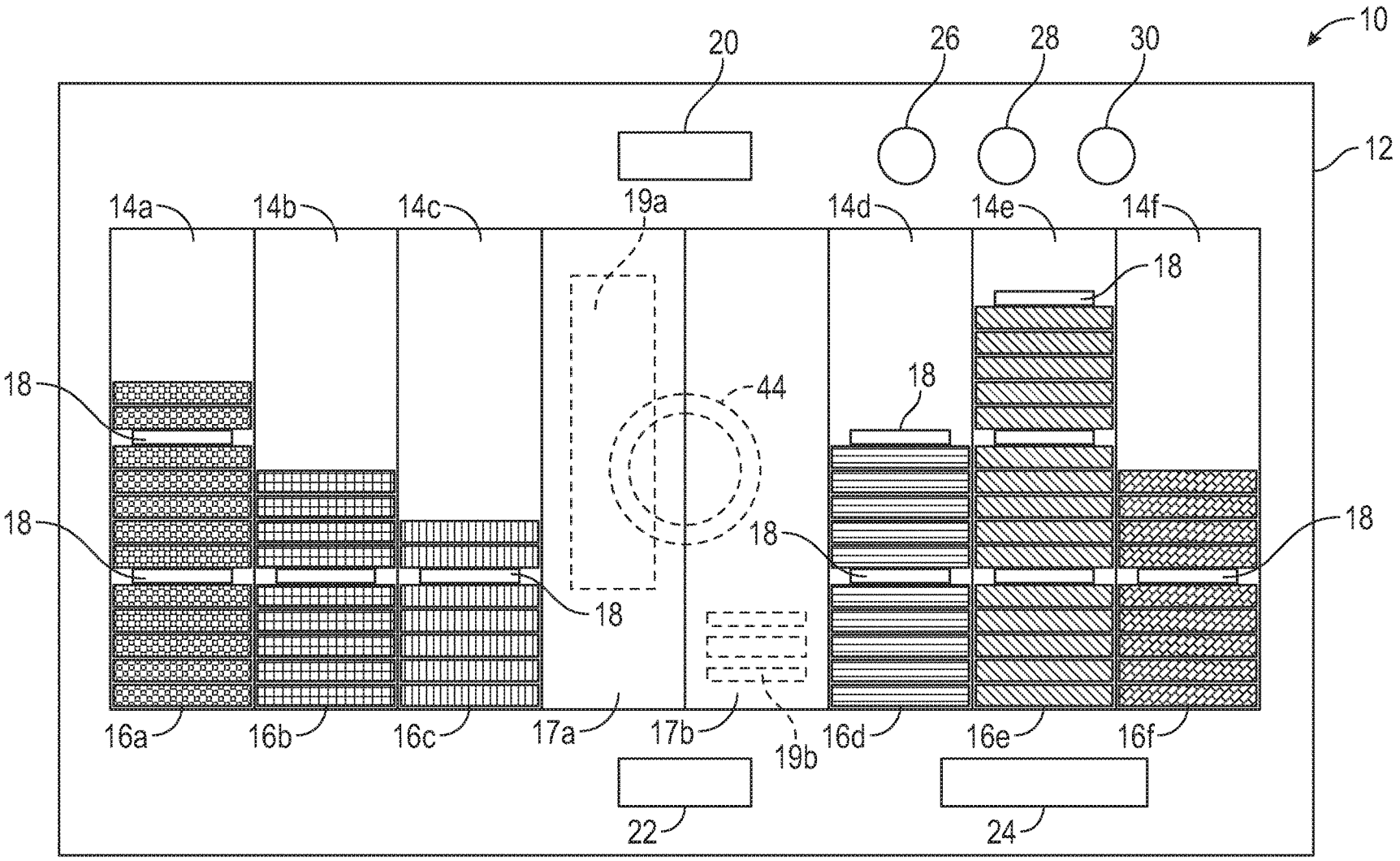
FIG. 1 is a plan view of a casino chip tray in accordance with embodiments of the invention.

Referring now to FIG. 1, one non-limiting embodiment of a casino chip tray is shown schematically at 10. The casino chip tray 10 is configured for use in casino games and further configured for use in a casino chip tray monitoring system. Generally, the casino chip tray monitoring system is configured to provide a real-time status of the total dollar value of the gaming chips in the casino chip tray and the cash received and dispersed as a result of making change through the gaming chips in the casino chip tray. The real-time status of the total dollar value can be shown on one or more displays.

The term "gaming chip", as used herein, is defined to mean any token having a designated denomination and used as currency within a casino at gaming tables.

Referring again to FIG. 1, the casino chip tray 10 is formed from a substantially transparent, low glare housing 12 having a plurality of chip compartments (commonly called "tubes") 14*a*-14*f*, in which a plurality of conventional gaming chips 16*a*-16*f* are disposed. The phrase "substantially transparent, low glare", as used herein, is defined to mean that the casino chip tray 10 is sufficiently transparent and has sufficiently low glare such that the gaming chips 16*a*-16*f* are distinguishable when viewed from a location below the casino chip tray 10 or from a position adjacent the columns of gaming chips. The term "chip tube", as used herein, is defined to mean a structure in which a plurality of gaming chips are maintained and arranged in a substantial column, as is conventional in the art. While the embodiment of the casino chip tray 10 illustrated in FIG. 1 shows a quantity of six (6) chip tubes 14*a*-14*f*, it should be appreciated that in other embodiments, the casino chip tray 10 can have more or less than six (6) chip tubes 14*a*-14*f*.

Referring again to FIG. 1, optionally the casino chip tray 10 can include additional chip tubes 17*a*, 17*b*. The chip tubes 17*a*, 17*b* can be configured to contain paper cash and coins (shown schematically in phantom at 19*a*) and/or gaming chips and one or more chip spacers (shown in phantom at 19*b*). However, it should be appreciated that the additional chip tubes 17*a*, 17*b* are not required for operation of the casino chip tray monitoring system.

Referring again to FIG. 1, the plurality of gaming chips 16*a*-16*f* form columns within the chip tubes 14*a*-14*f*. Optionally, the formed columns can be interrupted by the chip spacers 18. The chip spacers 18 can be used to space apart known quantities of gaming chips, as is conventional in the art. However, it should be appreciated that the use of the chip spacers 18 is not required for successful operation of the casino chip tray monitoring system.

Referring again to the embodiment illustrated in FIG. 1, each of the gaming chips 16*a* disposed in column 14*a* has the same dollar denomination. As non-limiting examples, each of the casino chips 16*a* can have a one dollar ($1.00), five dollar ($5.00) or twenty-five ($25.00) dollar denomination and the like. Similarly, each of the casino chips 16*b*-16*f* respectively disposed in columns 14*b*-14*f* can have the same dollar denominations.

Referring again to FIG. 1, the housing 12 includes first and second displays 20, 22, an input device 24, a first indicator 26, a second indicator 28 and a third indicator 30. The first display 20 is configured to display, in real time, a total dollar amount representing the dollar value of the gaming chips 16*a*-16*f* disposed within the chip tubes 14*a*-14*f* and the dollar amount of the cash received for chip purchases and/or change contained in chip tube 17*a*. The second display 22 is configured to display, in real time, the dollar amount of the cash received for chip purchases and/or change contained in chip tube 17*a*. While the embodiment of the housing shown in FIG. 1 includes two distinct displays 20, 22, in alternate embodiments a lone display having one or more display elements can be used.

Referring again to the embodiment illustrated in FIG. 1, the first and second displays 20 and 22 are digital readouts, such as the non-limiting example of liquid crystal displays ("LCD). However, in other embodiments, other structures, mechanisms and devices can be used sufficient to display the information described herein.

Referring again to FIG. 1, the input device 24 is configured to record transactions occurring at the gaming site. Non-limiting examples of gaming site transaction include receiving cash, receiving chips, tendering cash and tendering chips. In the illustrated embodiment, the input device 24 is an electronic keypad. Alternatively, other structures, mechanisms and devices can be used sufficient to record transactions occurring at the gaming site.

Referring again to FIG. 1, the first, second and third indicators 26, 28 and 30 are used to notify casino personnel, in real time, as to the status of the cash value indicated by the first display 20 in comparison with a desired cash value. In the illustrated embodiment, the first indicator 26 is illuminated as a green light in the event the cash value indicated by the first display 20 equals a desired cash value, the second indicator 28 is illuminated as a yellow light in the event the cash value indicated by the first display 20 is temporarily different than the desired cash value and the third indicator 30 is illuminated as a red light in the event the cash value indicated by the first display 20 is different than the desired cash value for a time exceeding the set time. The set time can be any desired pre-determined time. In the illustrated embodiment, the first, second and third indicators 26, 28 and 30 have the form of illuminable light bulbs. However, in other embodiments, other structures, mechanisms and devices can be used sufficient to display the status of the cash value indicated by the first display as described above. While the embodiment of the casino chip tray 10 shown in FIG. 1 includes three distinct indicators 26, 28, and 30, in alternate embodiments a lone indicator having the capability of different colors or different signaling indications can be used.

Figure 2:
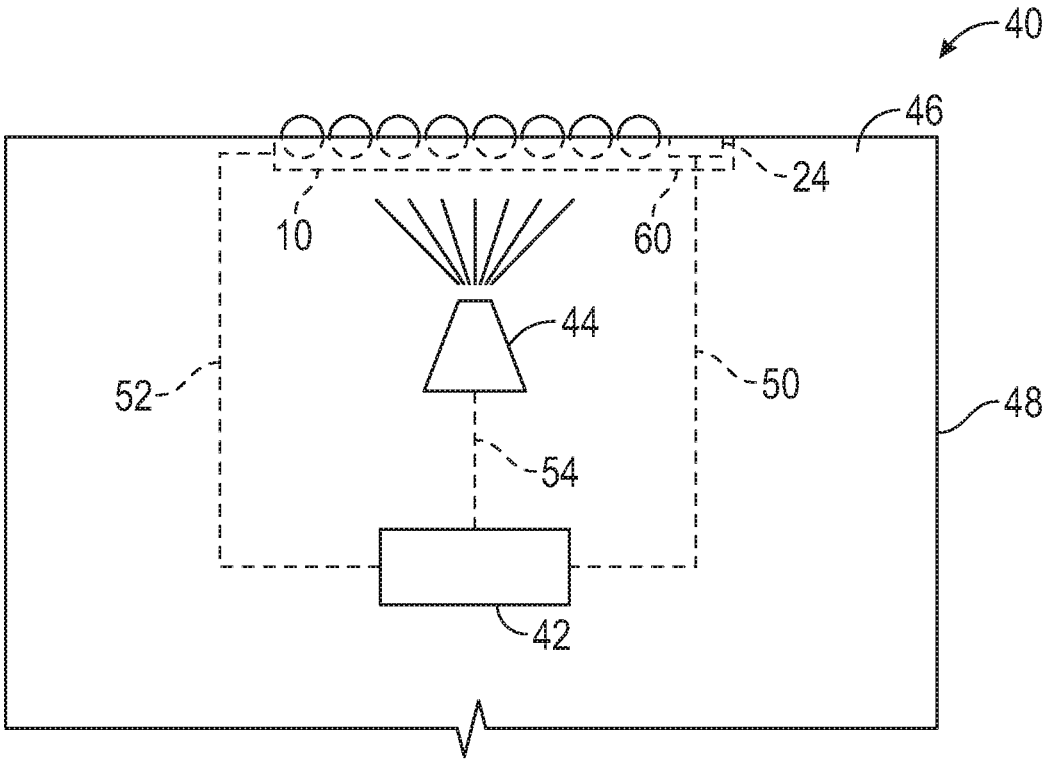
FIG. 2 is a side view of a casino chip tray monitoring system of the casino chip tray of FIG. 1.

Referring now to FIG. 2, a casino chip tray monitoring system 40 (hereafter "monitoring system") is schematically illustrated. The monitoring system 40 includes the casino chip tray 10, a controller 42 and an imaging device 44.

Referring again to FIG. 2, the casino chip tray 10 is disposed adjacent to an upper surface 46 of a casino gaming table 48. The casino gaming table can be any casino table employing casino chip trays, including the non-limiting examples of casino gaming tables include blackjack tables, poker tables, roulette tables and the like. In the illustrated embodiment, the casino chip tray 10 is positioned in a substantially flush orientation with the upper surface 46, such as not to interfere with the distribution of cards at the gaming table 48. However, the substantially flush orientation of the casino chip tray 10 is not required for successful operation of the monitoring system 40. It is contemplated that in other embodiments, the casino chip tray 10 can be tilted such as to be at an angle relative to the upper surface 46 of the casino gaming table 48.

Referring again to FIG. 2, the controller 42 is in electrical communication with the input device 24 via one or more electrical connectors 50. The controller 42 is also in electrical communication with the first and second displays 20, 22 and the first, second and third indicators 26, 28 and 30 via one or more electrical conduits 52 (the first and second displays 20, 22 and the first, second and third indicators 26, 28 and 30 are not shown for purposes of clarity). The controller 42 is further in electrical communication with the imaging device 44 via one or more electrical connectors 54. While the embodiment illustrated in FIG. 2 shows the controller 42, imaging device 44 and electrical connectors 50, 52 and 54 as being positioned below the gaming table 48, such is not required for successful operation of the monitoring system 40. It is contemplated that the imaging device 44 can be positioned below, above or adjacent to the casino chip tray 10.

Referring again to FIG. 2, the controller 42 is configured for several functions. First, the controller 42 is configured to receive input signals from the input device 24. Second, the controller 42 is configured to control operation of the imaging device 44 as will be described in more detail below. Third, the controller 42 is configured to receive input signals from the imaging device 44. Fourth, the controller 42 is configured to analyze the quantity and colors of the gaming chips 16*a*-16*f*. Fifth, the controller 42 is configured to receive transactional data from the input device 24. Sixth, the controller 42 is configured to calculate the total dollar value of the gaming chips and the cash and subsequently signal the first display 20 to display the calculated total dollar value. Finally, the controller 42 is configured to send illumination signals to the proper indicator 26, 28 or 30.

Referring again to FIG. 2, the controller 42 can have any desired form, including the non-limiting examples of a programmable logic controller (PLC), dedicated microprocessor and the like. Optionally, the controller 42 can be equipped with back-up power for operation during power shortages.

Referring again to FIG. 2, the imaging device 44 is configured to scan a bottom 60 of the casino chip tray 10. Since the casino chip tray 10 is substantially transparent and low glare, the imaging device 44 is further configured to view individual gaming chips through the casino chip tray 10. Finally, the imaging device 44 is configured to send scanned digital images of the gaming chips contained in the casino chip tray 10 to the controller 42. In the illustrated embodiment, the imaging device 44 is a digital camera having sufficient resolution to discern individual gaming chips. However, it is also contemplated that other structures, mechanisms and devices can be used, sufficient to view individual gaming chips through the casino chip tray 10 and send scanned digital images of the gaming chips contained in the casino chip tray 10 to the controller 42. It is also contemplated that one or more photographic anti-moire filters can be incorporated to help in minimizing the appearance of dust and minor scratches present on the bottom of the casino chip tray 10.

Figure 3:
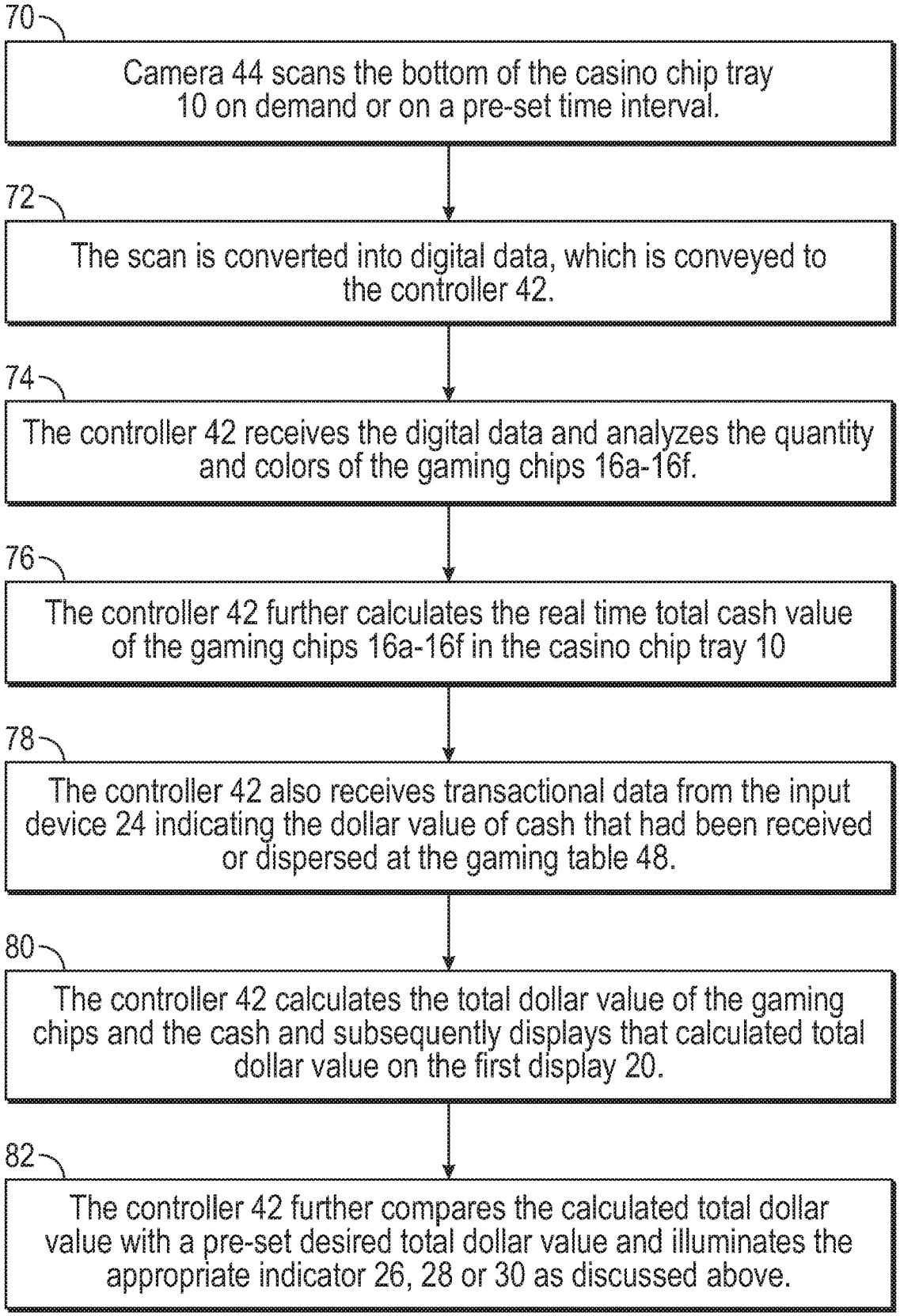
FIG. 3 is a flow chart illustrating the step of using the casino chip tray monitoring system of FIG. 2.

Referring now to FIG. 3, operation of the monitoring system 40 will now be described. In a first step 70, the imaging device 44 scans the bottom of the casino chip tray 10 on demand or on a pre-set time interval. Since the casino chip tray 10 is substantially transparent and low glare, the individual gaming chips 16*a*-16*f* contained in the chip tubes 14*l*-14*f* are discernable by the imaging device 44. The imaging device 44 scans the gaming chips 16*a*-16*f* with sufficient resolution to identify the quantity and colors of the gaming chips 16*a*-16*f*. In a next step 72, the scan is converted into digital data by the imaging device 44, which is conveyed to the controller 42 via electrical connectors 54. In next step 74, the controller 42 receives the digital data and analyzes the quantity and colors of the gaming chips 16*a*-16*f*. Next, in step 76, using the analyzed data, the controller 42 further calculates the real time total cash value of the gaming chips 16*a*-16*f* in the casino chip tray 10. In a next step 78, the controller 42 also receives transactional data from the input device 24 indicating the dollar value of cash that has been received or dispersed at the gaming table 48. In a further step 80, the controller 42 calculates the total dollar value of the gaming chips and the cash and subsequently displays that calculated total dollar value on the first display 20. In a final step 82, the controller 42 further compares the calculated total dollar value with a pre-set desired total dollar value and illuminates the appropriate indicator 26, 28 or 30 as discussed above. A glance at the indicator 26, 28 or 30 provides casino personnel with an indication if the total dollar value of the gaming chips and the cash contained in the casino chip tray 10 matches a pre-set value. It should be appreciated that in a scenario where cash is not accumulated on the casino chip tray 10, the first display 20 is configured to display only the total dollar value of the gaming chips.

While the embodiment of the casino chip tray 10 shown in FIG. 1 includes first and second displays 20, 22 and first, second and third indicators 26, 28, and 30, it should be appreciated that in other embodiments the first and/or second displays 20, 22 and the first, second and third indicators 26, 28, and 30 can be positioned in locations remote from the casino chip tray 10.

Referring again to the embodiment shown in FIG. 2, the imaging device 44 is configured to scan the chips 16*a*-16*f* in an interval time period of about 3.0-15.0 seconds. However, in other embodiments, the interval time period can be less than about 3.0 seconds or more than about 15.0 seconds, sufficient to provide a real time accounting of the gaming chips 16*a*-16*f* in the casino chip tray 10.

The monitoring system 40 provides many benefits, although all benefits may not be present in all embodiments. First, monitoring system 40 eliminates the need to take breaks in the gaming action to count/verify the dollar value of the gaming chips located in the casino chip tray 10. Second, the monitoring system 40 can be configured to ignore the chip spacers 18, thereby permitting their continued use within the casino chip tray 10. Third, the monitoring system 40 provides a real time display of the total dollar value of the gaming chips and/or coins in the casino chip tray 10. Fourth, the monitoring system 40 provides a real time display of the total dollar value of the gaming chips in the casino chip tray 10 and the net of the transactional cash received/dispersed. Fifth, the monitoring system 40 provides a quick glance, color-coded indicator 26, 28 or 30 showing the status of the total dollar value of the gaming chips and cash compared to a pre-set desired total dollar amount. Sixth, the monitoring system 40 increases the security for the casino.

Figure 4:
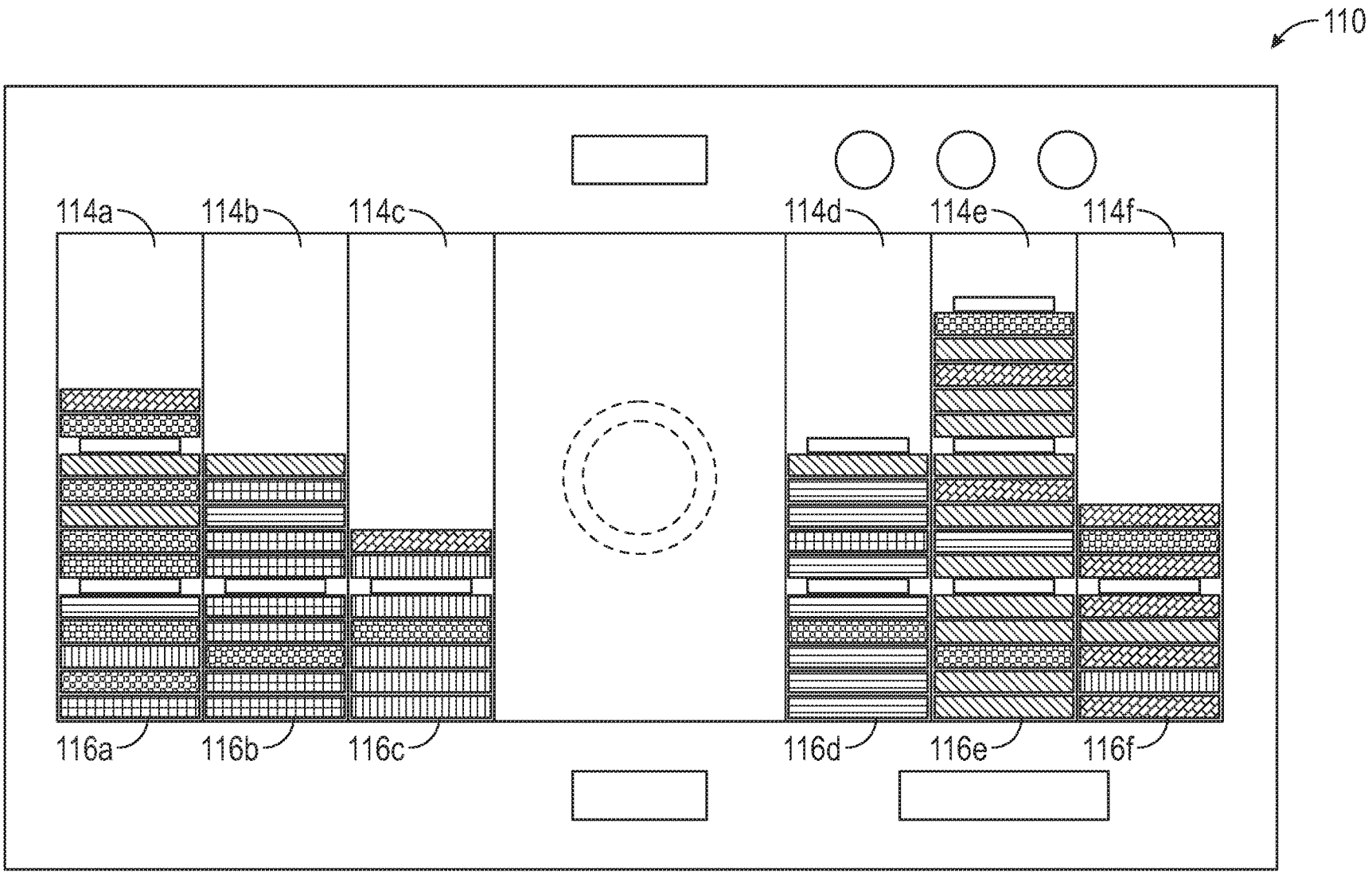
FIG. 4 is a plan view of a second embodiment of a casino chip tray in accordance with the invention.

While the embodiment shown in FIG. 1 illustrates each of the chip tubes 14*a*-14*f* as having a column of identical value chips, it is within the contemplation of the monitoring system 40 that the chip tubes 14*a*-14*f* can contain gaming chips having different values (and therefore different colors). Referring now to FIG. 4, a casino chip tray 110 includes chip tubes 114*a*-114*f*. In the illustrated embodiment, the casino chip tray 110 and the chip tubes 114*a*-114*f* are the same as the casino chip tray 10 and the chip tubes 14*a*-14*f* shown in FIG. 1 and described above. However, in alternate embodiments, the casino chip tray 110 and the chip tubes 114*a*-114*f* can be different from the casino chip tray 10 and the chip tubes 14*a*-14*f*.

Referring again to FIG. 4, each of the chip tubes 114*a*-114*f* includes a plurality of gaming chips 116*a*-116*f*. Rather than the gaming chips 116*a*-116*f* being arranged in column of similar value gaming chips, the gaming chips 116*a*-116*f* are randomly arranged such that adjacent gaming chips 116*a*-116*f* can have the same or differing dollar values. In this scenario, the monitoring system 40 is configured to operate as described above, advantageously eliminating the need to sort the gaming chips 116*a*-116*f* into columns of like-value gaming chips.

Figure 5:
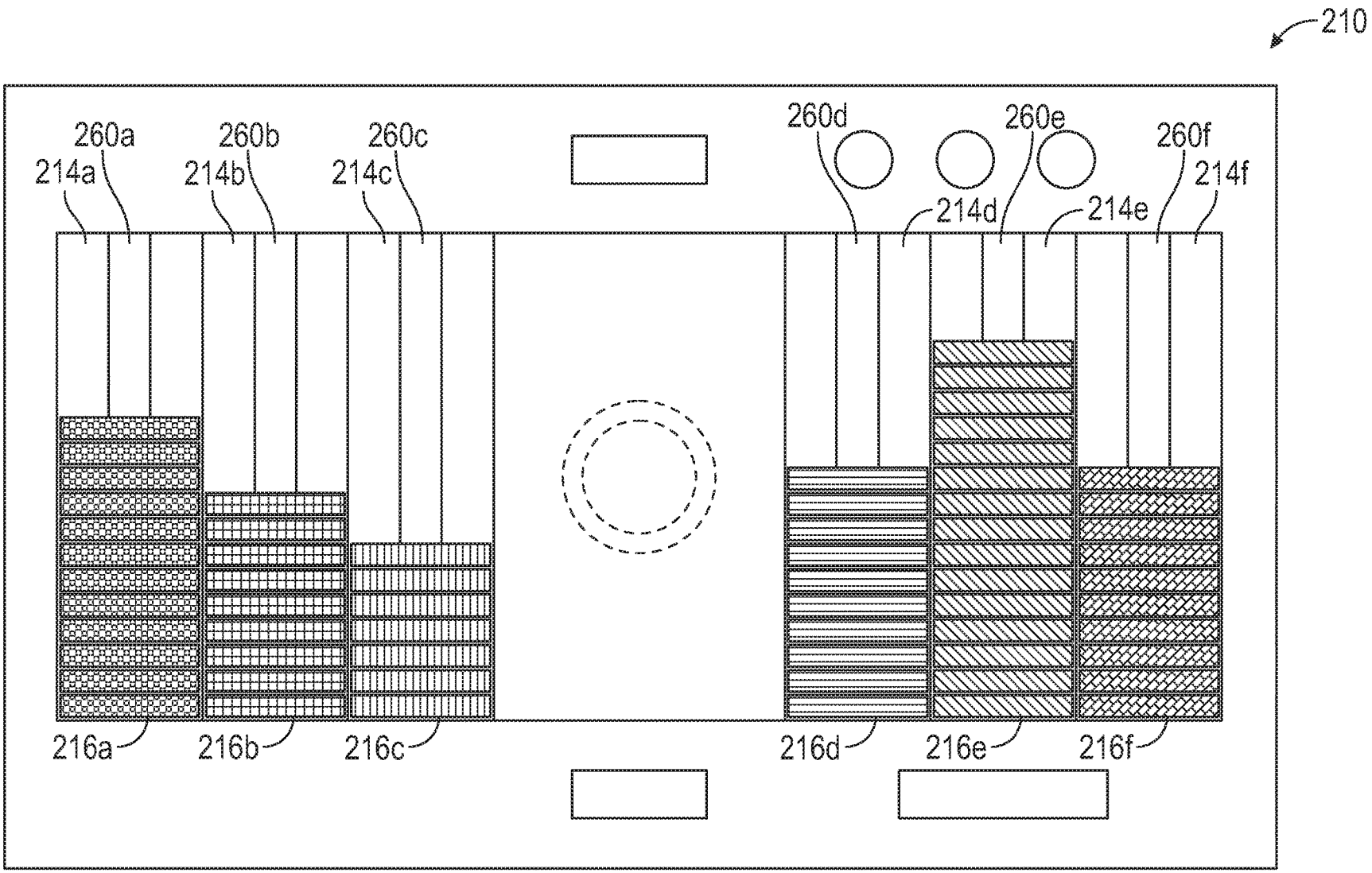
FIG. 5 is a plan view of a third embodiment of a casino chip tray in accordance with the invention.

While the embodiment of the casino chip tray 10 shown in FIG. 1 is described as being substantially transparent and low glare such that the gaming chips can be scanned by a imaging device 44 from below, it is within the contemplation of the monitoring system 40 that the casino chip tray 10 can be configured in other manners and still allow the scanning of the gaming chips by an imaging device from a remote location. Referring now to FIG. 5, one non-limiting example of an alternate casino chip tray is shown generally at 210. The casino chip tray 210 includes chip tubes 214*a*-214*f*, each with a column of gaming chips 216*a*-216*f*. Each of the chip tubes 214*a*-214*f* is configured with a longitudinal slot 260*a*-260*f*. In the event the casino chip tray 210 is formed from an opaque material, the slots 260*a*-260*f* are configured to provide visibility to the columns of chips 216*a*-216*f* in the chip tubes 214*a*-214*f*. It should be appreciated that the slots 260*a*-260*f* can have any configuration sufficient to provide visibility to the columns of gaming chips 216*a*-216*f* in the chip tubes 214*a*-214*f*. It should also be appreciated that the chip tubes 214*a*-214*f* can include other structures and arrangements sufficient to provide visibility to the columns of gaming chips 216*a*-216*f* in the chip tubes 214*a*-214*f*.

Figure 6:
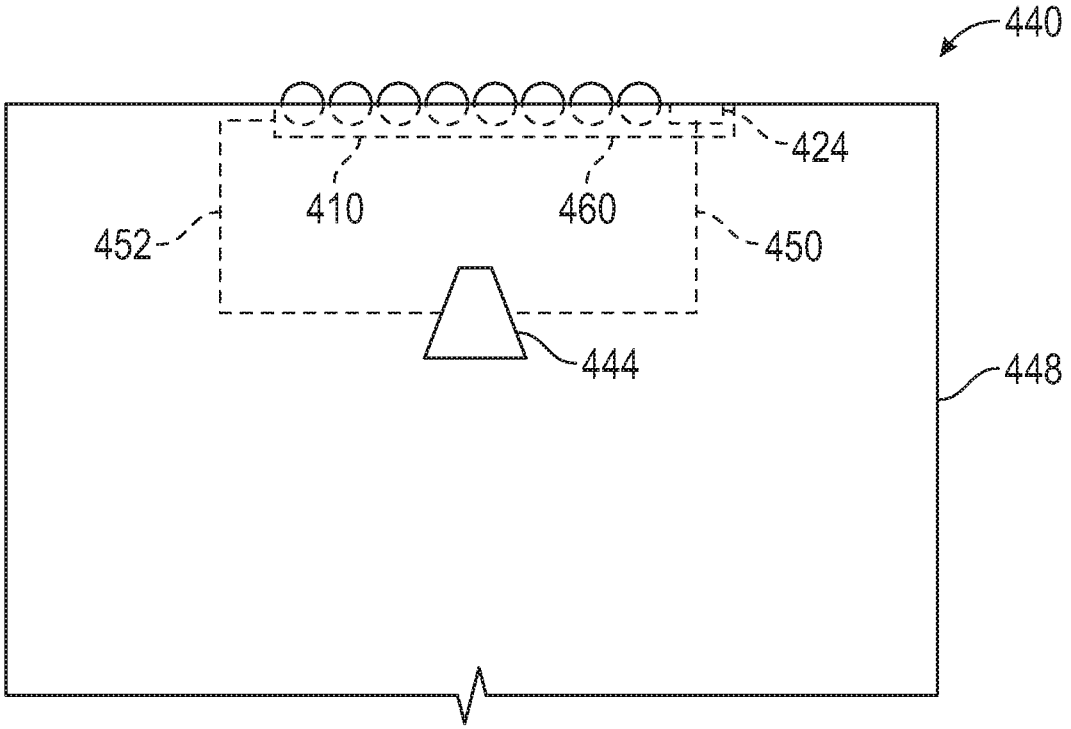
FIG. 6 is a side view of a second embodiment of a casino chip tray monitoring system.

While the monitoring system 40 illustrated in FIG. 2 is described above as using a controller 42 to receive digital data from the imaging device 44 and subsequently analyzing the quantity and colors of the gaming chips 16*a*-16*f*, it is contemplated that in other embodiments, the imaging device can be configured to analyze the quantity and colors of the gaming chips 16*a*-16*f*. Referring now to FIG. 6, a monitoring system 440 is illustrated. The monitoring system 440 includes a casino chip tray 410, an imaging device 444, electrical connectors 450, 452 and a gaming table 448. In the illustrated embodiment, the casino chip tray 410 and the gaming table 448 are the same as, or similar to, the casino chip tray 10 and the gaming table 48 illustrated in FIG. 2 and described above. In alternate embodiments, the casino chip tray 410 and the gaming table 448 can be different from the casino chip tray 10 and the gaming table 48.

Referring again to FIG. 6, the imaging device 444 is configured to scan a bottom 460 of the casino chip tray 410, thereby viewing individual gaming chips through the casino chip tray 410. In this embodiment, rather than the imaging device 444 sending scanned digital images of the gaming chips to a controller, the imaging device 444 is further configured to accomplish the functions performed by the controller 42, as shown in FIG. 2. Namely, in this embodiment, the imaging device 444 is configured to receive input signals from an input device 424, analyze the quantity and colors of the gaming chips contained in the casino chip tray 410, calculate the total dollar value of the gaming chips and the cash and subsequently signal the first display to display the calculated total dollar value and send illumination signals to the proper indicator.

The principle and mode of operation of the casino chip tray monitoring system have been described in certain embodiments. However, it should be noted that the casino chip tray monitoring system might be practiced otherwise than as specifically illustrated and described without departing from its scope.

What is claimed is:

1. A casino chip tray monitoring system configured for use with a casino game, the casino chip tray monitoring system comprising:

a casino chip tray having a plurality of chip tubes and one or more displays positioned adjacent the chip tubes, the casino chip tray further having a first indicator, a second indicator and a third indicator, the first, second and third indicators positioned adjacent the chip tubes;

a plurality of gaming chips, chip spacers and/or a plurality of coins arranged in the plurality of chip tubes; and an imaging device configured to scan the plurality of gaming chips, chip spacers and/or plurality of coins arranged in the plurality of chip tubes and also configured to discern the chip spacers from gaming chips and further configured to discern individual gaming chips from other gaming chips, wherein a total dollar value of the plurality of gaming chips and/or plurality of coins arranged in the plurality of chip tubes can be calculated from an imaging device scan of the plurality of gaming chips and/or plurality of coins and displayed on the one or more displays, and wherein the first indicator is configured to signal if the total dollar value of the plurality of gaming chips and/or plurality of coins arranged in the plurality of chip tubes shown by the one or more displays equals a desired pre-set cash value, the second indicator is configured to signal if the total dollar value of the plurality of gaming chips and/or plurality of coins arranged in the plurality of chip tubes shown by the one or more displays is different than the desired cash value for a pre-set period of time and the third indicator is configured to signal if the total dollar value of the plurality of gaming chips and/or plurality of coins arranged in the plurality of chip tubes shown by the one or more displays is different than the desired cash value for a pre-set period of time that is longer than the pre-set period of time used for the second indicator.

2. The casino chip tray monitoring system of claim 1, wherein the casino chip tray is formed from transparent materials.

3. The casino chip tray monitoring system of claim 1, wherein the casino chip tray includes a longitudinal slot configured to allow the imaging device to scan the plurality of gaming chips and/or the plurality of coins arranged in the plurality of chip tubes.

4. The casino chip tray monitoring system of claim 1, wherein the imaging device is positioned below the casino chip tray.

5. The casino chip tray monitoring system of claim 1, wherein the imaging device is positioned above the casino chip tray.

6. The casino chip tray monitoring system of claim 1, wherein the gaming chips are arranged in the chip tubes with like dollar denominations in the same columns.

7. The casino chip tray monitoring system of claim 1, wherein the gaming chips are randomly arranged in the chip tubes in a manner such that a column of gaming chips can have dissimilar dollar denominations.

8. The casino chip tray monitoring system of claim 1, wherein the imaging device is a digital camera.

9. The casino chip tray monitoring system of claim 1, wherein the one or more indicators is a light.

10. A method of using a casino chip tray monitoring system configured for use with a casino game, the method comprising the steps of:

arranging a plurality of gaming chips, chip spacers and/or a plurality of coins in a plurality of chip tubes of a casino chip tray, the casino chip tray having one or more displays positioned adjacent the plurality of chip tubes and further having a first indicator, a second indicator and a third indicator, the first, second and third indicators positioned adjacent the chip tubes;

scanning the plurality of gaming chips, chip spacers and/or the plurality of coins arranged in the plurality of chip tubes with an imaging device, the imaging device configured to discern individual gaming chips from other gaming chips and also configured to discern chip spacers from gaming chips;

calculating a total dollar value of the plurality of gaming chips and/or the plurality of coins arranged in the plurality of chip tubes from an imaging device scan of the plurality of gaming chips and/or plurality of coins; and displaying the calculated total dollar value on one or more displays;

wherein the first indicator is configured to signal if the total dollar value of the plurality of gaming chips and/or plurality of coins arranged in the plurality of chip tubes shown by the one or more displays equals a desired pre-set cash value, the second indicator is configured to signal if the total dollar value of the plurality of gaming chips and/or plurality of coins arranged in the plurality of chip tubes shown by the one or more displays is different than the desired cash value for a pre-set period of time and the third indicator is configured to signal if the total dollar value of the plurality of gaming chips and/or plurality of coins arranged in the plurality of chip tubes shown by the one or more displays is different than the desired cash value for a pre-set period of time that is longer than the pre-set period of time used for the second indicator.

11. The method of using the casino chip tray monitoring system of claim 10, wherein the casino chip tray is formed from transparent materials.

12. The method of using the casino chip tray monitoring system of claim 10, wherein the casino chip tray includes a longitudinal slot configured to allow the imaging device to scan the plurality of gaming chips and/or the plurality of coins arranged in the plurality of chip tubes.

13. The method of using the casino chip tray monitoring system of claim 10, including the step of positioning the imaging device below the casino chip tray.

14. The method of using the casino chip tray monitoring system of claim 10, including the step of positioning the imaging device above the casino chip tray.

15. The method of using the casino chip tray monitoring system of claim 10, including the step of arranging the gaming chips in the chip tubes with like dollar denominations in the same columns.

16. The method of using the casino chip tray monitoring system of claim 10, including the step of randomly arranging the gaming chips in the chip tubes in a manner such that a column of gaming chips can have dissimilar dollar denominations.

17. The method of using the casino chip tray monitoring system of claim 10, wherein the imaging device is a digital camera.

18. The method of using the casino chip tray monitoring system of claim 10, wherein the one or more indicators is a light.

* * * * *